US005759274A

United States Patent [19]

Maier et al.

[11] Patent Number: 5,759,274

[45] Date of Patent: Jun. 2, 1998

[54] DIE COATING APPARATUS WITH SURFACE COVERING

[75] Inventors: Gary W. Maier, Warren Township, St. Croix County, Wis.; Omar D. Brown, St. Paul, Minn.

[73] Assignee: Minnesota Mining and Manufacturing Company, St. Paul, Minn.

[21] Appl. No.: 236,570

[22] Filed: Apr. 29, 1994

[51] Int. Cl.[6] ..... B05C 3/02

[52] U.S. Cl. ..... 118/410; 118/419

[58] Field of Search ..... 118/419, 410, 118/411, 413, DIG. 2

[56] References Cited

U.S. PATENT DOCUMENTS

| | | | |
|---|---|---|---|
| 2,681,294 | 6/1954 | Beguin | 117/34 |
| 2,761,791 | 9/1956 | Russell | 117/34 |
| 3,413,143 | 11/1968 | Cameron et al. | 117/120 |
| 4,332,840 | 6/1982 | Tanaka et al. . | |
| 4,443,504 | 4/1984 | Burket et al. | 427/445 |
| 4,445,458 | 5/1984 | O'Brien | 118/401 |
| 4,774,109 | 9/1988 | Hadzimihalis et al. . | |
| 4,876,982 | 10/1989 | Claassen | 118/419 |
| 5,030,484 | 7/1991 | Chino et al. . | |
| 5,256,357 | 10/1993 | Hayward | 264/171 |

FOREIGN PATENT DOCUMENTS

| | | |
|---|---|---|
| 0 196 029 A2 | 10/1986 | European Pat. Off. . |
| 0 466 420 A3 | 1/1992 | European Pat. Off. . |
| 0 484 738 A1 | 5/1992 | European Pat. Off. . |
| 0 545 084 A1 | 6/1993 | European Pat. Off. . |
| 0 552 653 A1 | 7/1993 | European Pat. Off. . |
| 0 566 124 A1 | 10/1993 | European Pat. Off. . |
| 0 609 768 A1 | 8/1994 | European Pat. Off. . |
| 2 375 914 | 7/1978 | France . |
| 3723149 A1 | 1/1988 | Germany . |
| 43 04281 A1 | 9/1993 | Germany . |
| 0157629 | 12/1989 | Japan . |
| 4-190870 | 7/1992 | Japan . |
| 1098434 | 1/1968 | United Kingdom . |
| 1192515 | 5/1970 | United Kingdom . |
| 2 040 738 | 9/1980 | United Kingdom . |
| 2 120 132 | 11/1983 | United Kingdom . |
| WO 93/14878 | 8/1993 | WIPO . |

OTHER PUBLICATIONS

Research Disclosure, No. 334, Emsworth, GB, pp. 111–117, XP291212, Manufacturing of Solvent–Based Image–Forming Materials.

*Primary Examiner*—Brenda A. Lamb
*Attorney, Agent, or Firm*—Charles D. Levine

[57] ABSTRACT

A die coating apparatus includes a die having an upstream bar with an upstream lip and a downstream bar with a downstream lip. The upstream lip is formed as a land and the downstream lip is formed as a sharp edge. A low surface energy covering is applied to the surface of the downstream bar adjacent to the sharp edge, and to the surface of the land, adjacent to its downstream edge. This presents a generally undulating surface. The low surface energy coverings need not extend completely to the edges of the downstream bar and the land.

1 Claim, 11 Drawing Sheets

| VIS (CPS) | Vw (M/MIN) | | Tw (MICRONS) | | CTG GAP (MM) | | VAC (MM H20) | |
|---|---|---|---|---|---|---|---|---|
| | PRIOR | NEW | PRIOR | NEW | PRIOR | NEW | PRIOR | NEW |
| 37.6 | 9.1 | | 22.2 | | 0.076 | | 190.5 | |
| 37.6 | | 18.3 | | 15.4 | | 0.076 | | 96.5 |
| 37.6 | | 24.4 | | 15.4 | | 0.076 | | 101.6 |
| 39.5 | 18.3 | 18.3 | 42 | 31 | 0.076 | 0.124 | 132.1 | 43.2 |
| 39.5 | 36.6 | 36.6 | 47.2 | 31 | 0.076 | 0.099 | 165.1 | 93.9 |
| 47 | 30.5 | 30.5 | 45.7 | 45.7 | 0.102 | 0.254 | 109.2 | 5.1 |
| 131.4 | 18.3 | 18.3 | 62 | 62 | 0.102 | 0.264 | 66 | 0 |
| 131.4 | | 38.1 | | 62 | | 0.305 | | 0 |
| 140 | 12.2 | 12.2 | 33.8 | 23.1 | 0.076 | 0.081 | 101.6 | 104.1 |
| 158 | 9.1 | | 46.5 | | 0.076 | | 76.2 | |
| 158 | | 15.2 | | 23.2 | | 0.076 | | 167.6 |
| 600 | 15.2 | 15.2 | 177.3 | 177.3 | 0.254 | 0.432 | 0 | 0 |
| 600 | 24.4 | 24.4 | 177.3 | 177.3 | 0.254 | 0.305 | 25.4 | 0 |

FIG. 13

DIE COATING APPARATUS WITH SURFACE COVERING

TECHNICAL FIELD

The present invention relates to coating methods. More particularly, the present invention relates to coating methods using a die.

BACKGROUND OF THE INVENTION

U.S. Pat. No. 2,681,294 discloses a vacuum method for stabilizing the coating bead for direct extrusion and slide types of metered coating systems. Such stabilization enhances the coating capability of these systems. However, these coating systems lack sufficient overall capability to provide the thin wet layers, even at very low liquid viscosities, required for some coated products.

U.S. Pat. No. 4,445,458 discloses an extrusion type bead-coating die with a beveled draw-down surface to impose a boundary force on the downstream side of the coating bead and to reduce the amount of vacuum necessary to maintain the bead. Reduction of the vacuum minimizes chatter defects and coating streaks. To improve coating quality, the obtuse angle of the beveled surface with respect to the slot axis, and the position along the slot axis of the bevel toward the moving web (overhang) and away from the moving web (underhang) must be optimized. The optimization results in the high quality needed for coating photosensitive emulsions. However, the thin-layer performance capability needed for some coated products is lacking.

A common problem encountered with extrusion die coaters has been the occurrence of streaks in the coated layer, caused by dried liquid residue on the die lips near the coating bead. This is especially true for low-viscosity liquids, containing a highly-volatile solvent. One solution to this problem, described in PCT Patent Application No. WO 93/14878 involves placing fluorine-containing resin coverings on the die faces adjacent to the lip faces to prevent wetting of these surfaces by coating liquid. This reduces streaking, dripping, and edge waviness. However, the coverings extend to the bead lip edges, and result in non-precision mechanical alignment components which are easily damaged.

European Patent Application No. EP 552653 describes covering a slide coating die surface adjacent to and below the coating bead with a low energy fluorinated polyethylene surface. The covering starts 0.05–5.00 mm below the coating lip tip and extends away from the coating bead. The low-surface-energy covering is separated from the coating lip tip by a bare metal strip. This locates the bead static contact line. The low energy covering eliminates coating streaks and facilitates die cleanup. No mention is made of using this with an extrusion coating die.

FIG. 1 shows a known coating die 10 with a vacuum chamber 12 as part of a metered coating system. A coating liquid 14 is precisely supplied by a pump 16 to the die 10 for application to a moving web 18, supported by a backup roller 20. Coating liquid is supplied through a channel 22 to a manifold 24 for distribution through a slot 26 in the die and coating onto the moving web 18. As shown in FIG. 2, the coating liquid passes through the slot 26 and forms a continuous coating bead 28 between the upstream die lip 30 and the downstream die lip 32, and the web 18. Dimensions $f_1$ and $f_2$, the width of the lips 30, 32 commonly range from 0.25 to 0.76 mm. The vacuum chamber 12 applies a vacuum upstream of the bead to stabilize the bead. While this configuration works adequately in many situations, there is a need for a die coating method which improves the performance of known methods.

SUMMARY OF THE INVENTION

The present invention is a die coating apparatus for coating fluid coating onto a surface. The apparatus includes a die having an upstream bar with an upstream lip and a downstream bar with a downstream lip. The upstream lip is formed as a land and the downstream lip is formed as a sharp edge. A passageway runs through the die between the upstream and downstream bars. The passageway has a slot defined by the upstream and downstream lips, and coating fluid exits the die from the slot to form a continuous coating bead between the upstream die lip, the downstream die lip, and the surface being coated. A low surface energy covering is applied to the surface of the downstream bar adjacent to the sharp edge, and to the surface of the land, adjacent to its downstream edge. This presents a generally undulating surface. The low surface energy coverings need not extend completely to the edges of the downstream bar and the land. The bead does not significantly move into the space between the land and the surface to be coated even as vacuum is increased.

BRIEF DESCRIPTION OF THE DRAWINGS

FIG. 13 is a collection of data from coating tests.

DETAILED DESCRIPTION

This invention is a die coating method and apparatus where the die includes a sharp edge and a land which are positioned to improve and optimize performance. The land is configured to match the shape of the surface in the immediate area of coating liquid application. The land can be curved to match a web passing around a backup roller or the land can be flat to match a free span of web between rollers.

Figure 1:
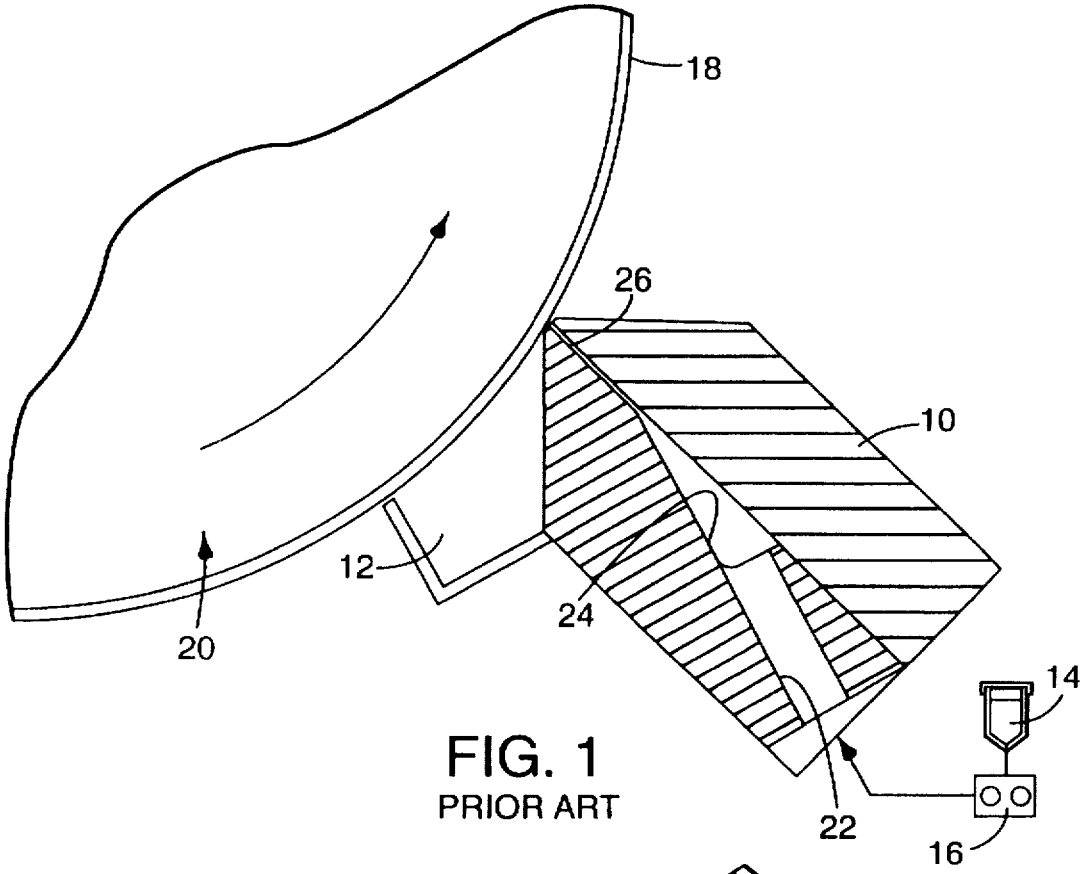
FIG. 1 PRIOR ART
FIG. 1 is a schematic, cross-sectional view of a known coating die.
Figure 2:
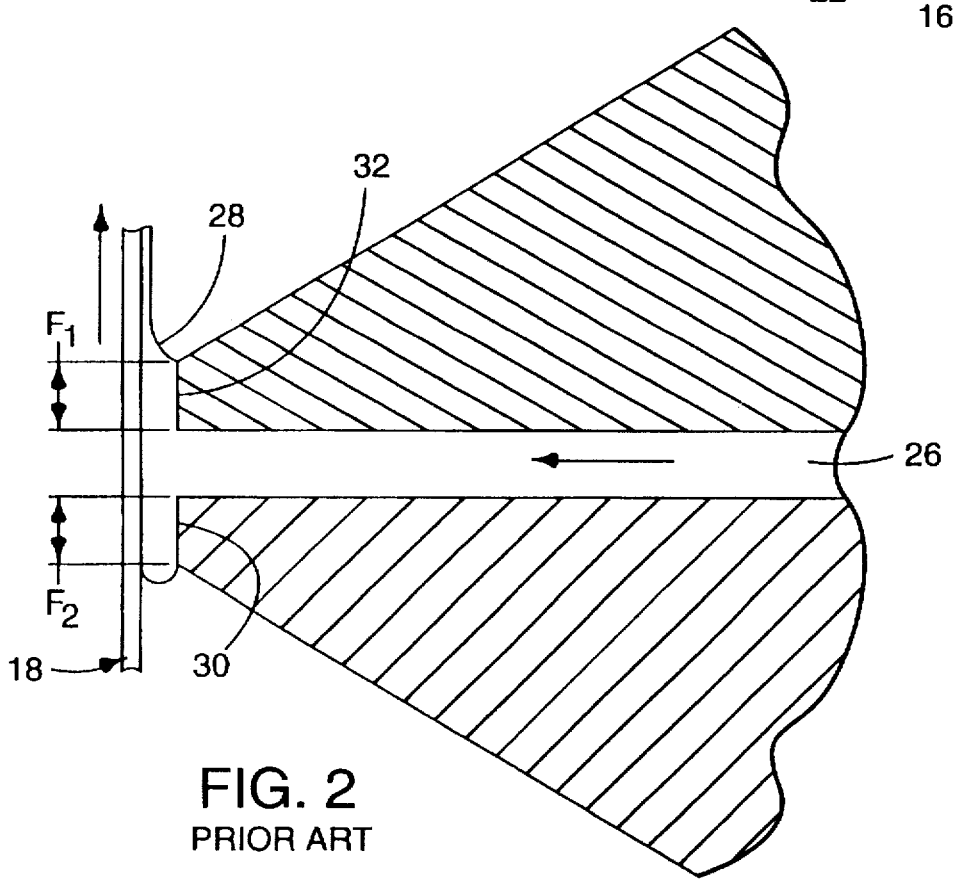
FIG. 2 PRIOR ART
FIG. 2 is an enlarged cross-sectional view of the slot and lip of the die of FIG. 1.
Figure 3:
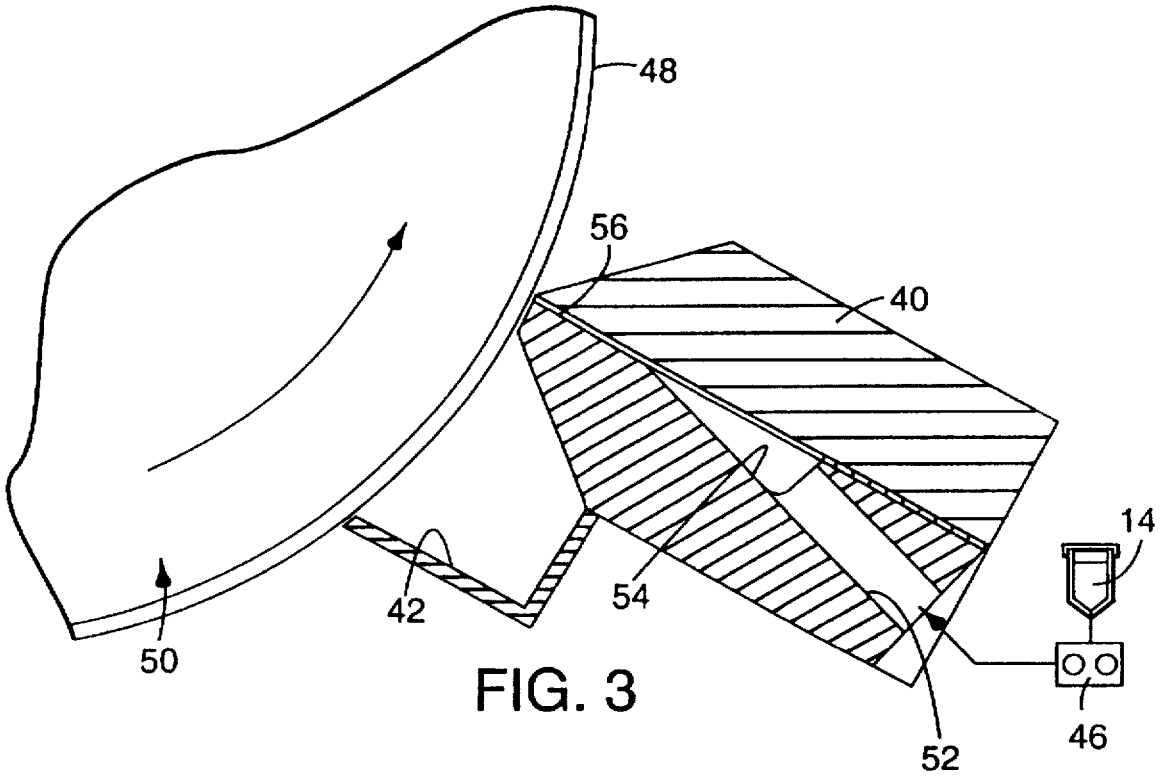
FIG. 3 is a cross-sectional view of an extrusion die of the present invention.
Figure 4:
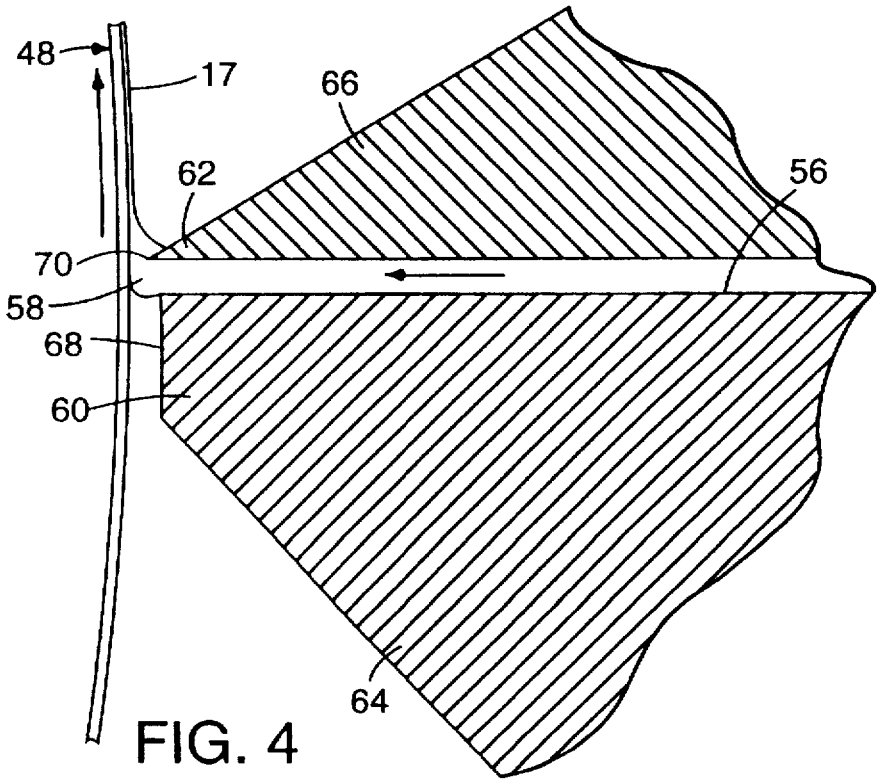
FIG. 4 is an enlarged cross-sectional view of the slot and lip of the die of FIG. 4.

FIG. 3 shows the extrusion die 40 with a vacuum chamber 42 of the present invention. Coating liquid 14 is supplied by a pump 46 to the die 40 for application to a moving web 48, supported by a backup roller 50. Coating liquid is supplied through a channel 52 to a manifold 54 for distribution through a slot 56 and coating onto the moving web 48. As shown in FIG. 4, the coating liquid 14 passes through the slot 56 and forms a continuous coating bead 58 among the upstream die lip 60, the downstream die lip 62, and the web 48. The coating liquid can be one of numerous liquids or other fluids. The upstream die lip 60 is part of an upstream bar 64, and the downstream die 62 lip is part of a downstream bar 66. The height of the slot 56 can be controlled by a U-shaped shim which can be made of brass or stainless steel and which can be deckled. The vacuum chamber 42 applies vacuum upstream of the bead to stabilize the coating bead.

Figure 5:
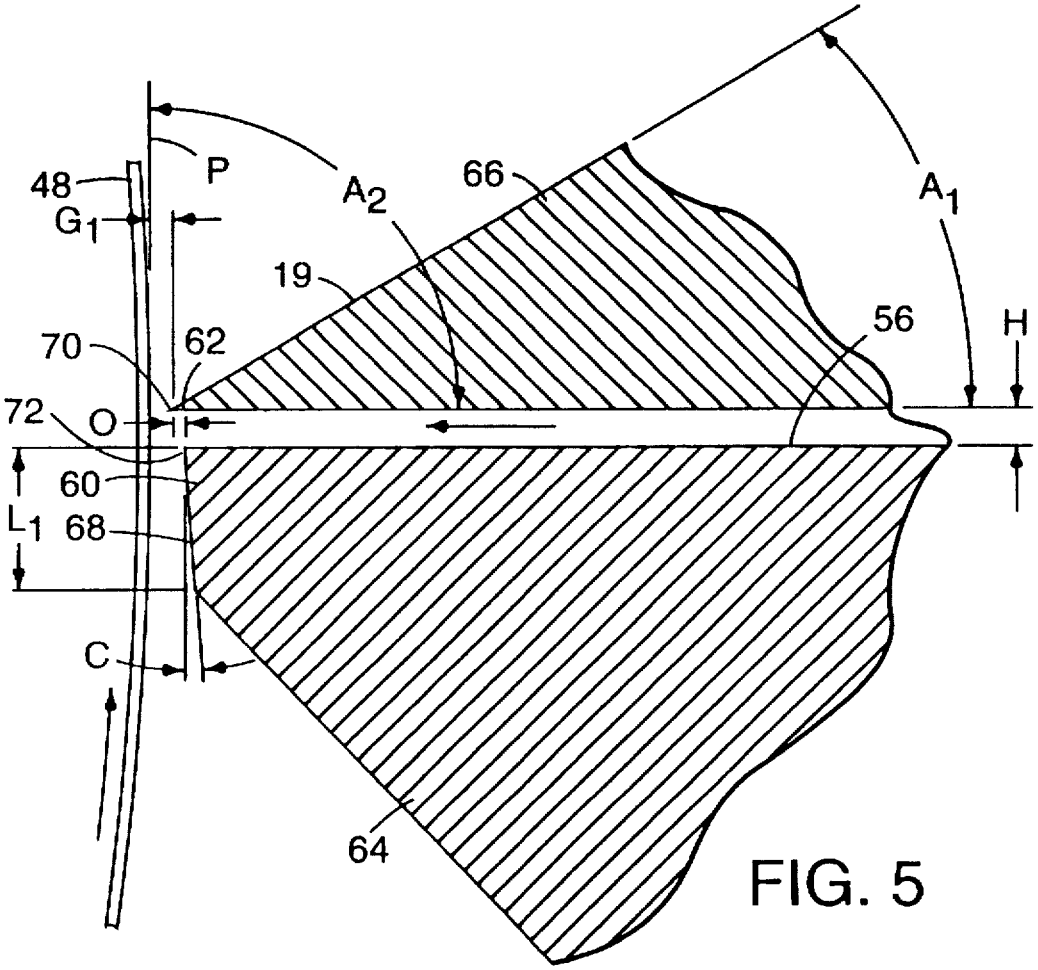
FIG. 5 is a cross-sectional view of the slot and lip similar to that of FIG. 4.

As shown in FIG. 5, the upstream lip 60 is formed as a curved land 68 and the downstream lip 62 is formed as a sharp edge 70. This configuration improves overall performance over that of known die-type coaters. Improved performance means permitting operating at increased web speeds and increased coating gaps, operating with higher coating liquid viscosities, and creating thinner wet coating layer thicknesses.

The sharp edge 70 should be clean and free of nicks and burrs, and should be straight within 1 micron in 25 cm of length. The edge radius should be no greater than 10 microns. The radius of the curved land 68 should be equal to the radius of the backup roller 50 plus a minimal, and non-critical, 0.13 mm allowance for coating gap and web thickness. Alternatively, the radius of the curved land 68 can exceed that of the backup roller 50 and shims can be used to orient the land with respect to the web 48. A given convergence C achieved by a land with the same radius as the backup roller can be achieved by a land with a larger radius than the backup roller by manipulating the land with the shims.

FIG. 5 also shows dimensions of geometric operating parameters for single layer extrusion. The length $L_1$ of the curved land 68 on the upstream bar 64 can range from 1.6 mm to 25.4 mm. The preferred length $L_1$ is 12.7 mm. The edge angle $A_1$ of the downstream bar 66 can range from 20° to 75°, and is preferably 600. The edge radius of the sharp edge 70 should be from about 2 microns to about 4 microns and preferably less than 10 microns. The die attack angle $A_2$ between the downstream bar 66 surface of the coating slot 56 and the tangent plane P through a line on the web 48 surface parallel to, and directly opposite, the sharp edge 70 can range from 60° to 120° and is preferably 90°–95°, such as 93°. The coating gap $G_1$ is the perpendicular distance between the sharp edge 70 and the web 48. (The coating gap $G_1$ is measured at the sharp edge but is shown in some Figures spaced from the sharp edge for drawing clarity. Regardless of the location of $G_1$ in the drawings—and due to the curvature of the web the gap increases as one moves away from the sharp edge—the gap is measured at the sharp edge.)

Slot height H can range from 0.076 mm to 3.175 mm. Overbite O is a positioning of the sharp edge 70 of the downstream bar 66, with respect to the downstream edge 72 of the curved land 68 on the upstream bar 64, in a direction toward the web 48. Overbite also can be viewed as a retraction of the downstream edge 72 of the curved land 68 away from the web 48, with respect to the sharp edge 70, for any given coating gap $G_1$. Overbite can range from 0 mm to 0.51 mm, and the settings at opposite ends of the die slot should be within 2.5 microns of each other. A precision mounting system for this coating system is required, for example to accomplish precise overbite uniformity. Convergence C is a counterclockwise, as shown in FIG. 5, angular positioning of the curved land 68 away from a location parallel to (or concentric with) the web 48, with the downstream edge 72 being the center of rotation. Convergence can range from 0° to 2.29°, and the settings at opposite ends of the die slot should be within 0.023° of each other. The slot height, overbite, and convergence, as well as the fluid properties such as viscosity affect the performance of the die coating apparatus and method.

From an overall performance standpoint, for liquids within the viscosity range of 1 centipoise to 1,000 centipoise, it is preferred that the slot height be 0.18 mm, the overbite be 0.076 mm, and the convergence be 0.57°. Performance levels using other slot heights can be nearly the same. Holding convergence at 0.57°, some other optimum slot height and overbite combinations are as follows:

| Slot Height | Overbite |
|---|---|
| 0.15 mm | 0.071 mm |
| 0.20 mm | 0.082 mm |
| 0.31 mm | 0.100 mm |
| 0.51 mm | 0.130 mm |

In the liquid viscosity range noted above, and for any given convergence value, the optimum overbite value appears to be directly proportional to the square root of the slot height value. Similarly, for any given slot height value, the optimum overbite value appears to be inversely proportional to the square root of the convergence value.

Figure 6:
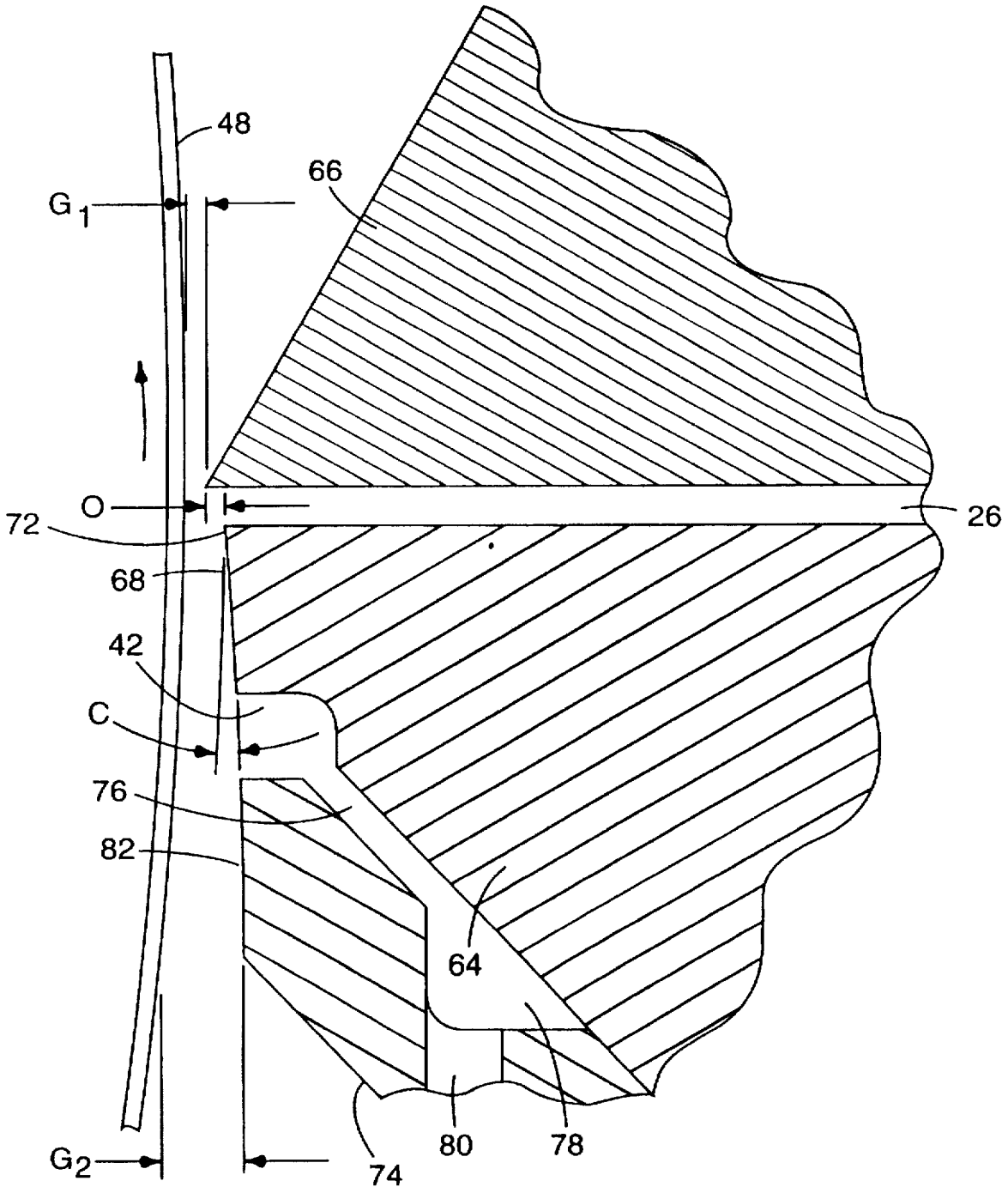
FIG. 6 is a cross-sectional view of an alternative vacuum chamber arrangement.

As shown in FIG. 6, the vacuum chamber 42 can be an integral part of, or clamped to, the upstream bar 64 to allow precise, repeatable vacuum system gas flow. The vacuum chamber 42 is formed using a vacuum bar 74 and can be connected through an optional vacuum restrictor 76 and a vacuum manifold 78 to a vacuum source channel 80. A curved vacuum land 82 can be an integral part of the upstream bar 64, or can be part of the vacuum bar 74, which is secured to the upstream bar 64. The vacuum land 82 has the same radius of curvature as the curved land 68. The curved land 68 and the vacuum land 82 can be finish-ground together so they are "in line" with each other. The vacuum land 82 and the curved land 68 then have the same convergence C with respect to the web 48.

The vacuum land gap $G_2$ is the distance between the vacuum land 82 and the web 48 at the lower edge of the vacuum land and is the sum total of the coating gap $G_1$, the overbite O, and the displacement caused by convergence C of the curved land 68. (Regardless of the location of $G_1$ in the drawings the gap is the perpendicular distance between the lower edge of the vacuum land and the web.) When the vacuum land gap $G_2$ is large, an excessive inrush of ambient air to the vacuum chamber 42 occurs. Even though the vacuum source may have sufficient capacity to compensate and maintain the specified vacuum pressure level at the vacuum chamber 42, the inrush of air can degrade coating performance.

Figure 7:
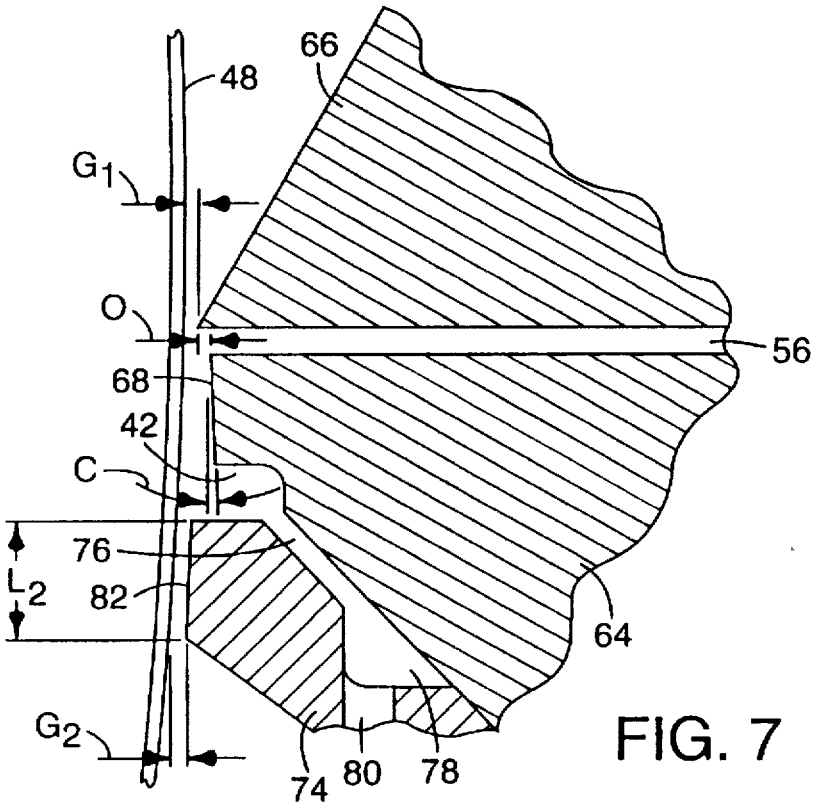
FIG. 7 is a cross-sectional view of another alternative vacuum chamber arrangement.

In FIG. 7, the vacuum land 82 is part of a vacuum bar 74 which is attached to the upstream bar 64. During fabrication, the curved land 68 is finished with the convergence C "ground in." The vacuum bar 74 is then attached and the vacuum land 82 is finish ground, using a different grind center, such that the vacuum land 82 is parallel to the web 48, and the vacuum land gap $G_2$ is equal to the coating gap $G_1$ when the desired overbite value is set. The vacuum land length $L_2$ may range from 6.35 mm to 25.4 mm. The preferred length $L_2$ is 12.7 mm. This embodiment has greater overall coating performance capability in difficult coating situations than the embodiment of FIG. 6, but it is always finish ground for one specific set of operating conditions. So, as coating gap $G_1$ or overbite O are changed vacuum land gap $G_2$ may move away from its optimum value.

Figure 8:
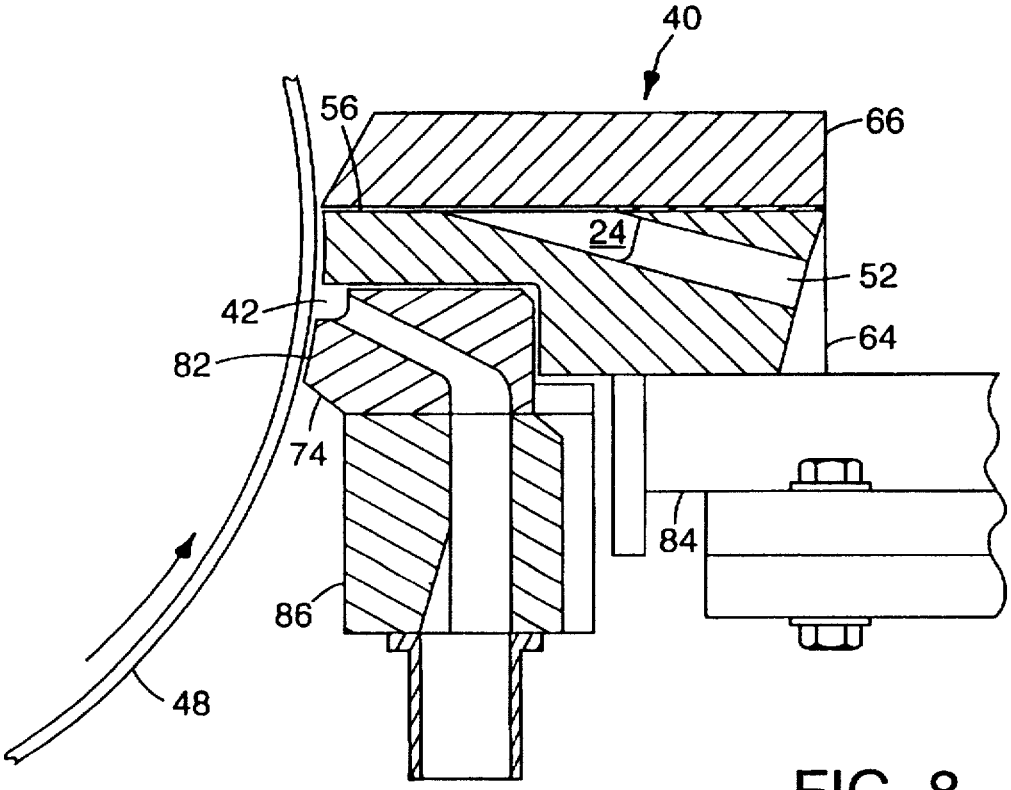
FIG. 8 is a cross-sectional view of an alternative extrusion die of the present invention.
Figure 9A:
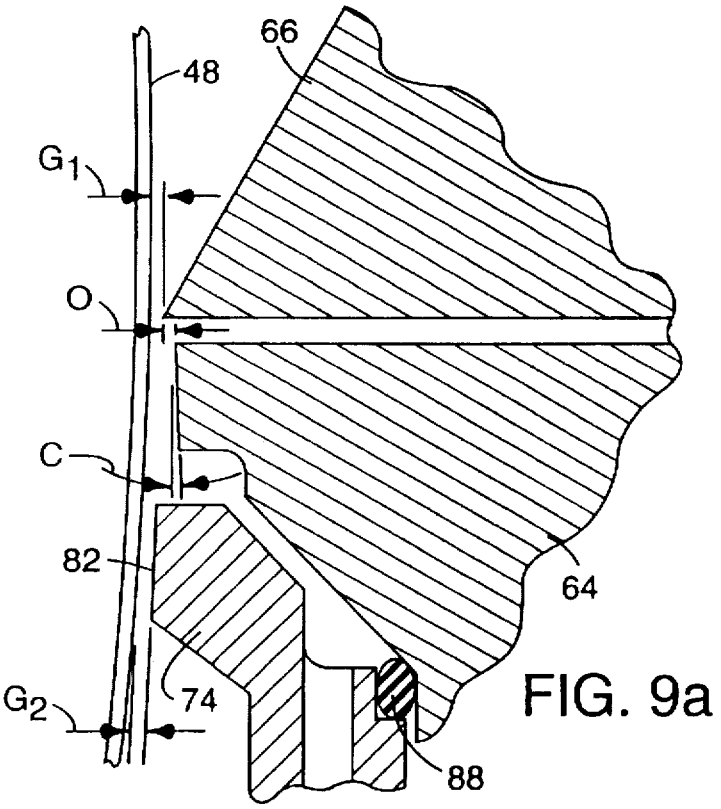
FIGS. 9*a* and 9*b* are enlarged cross-sectional views of the slot, face, and vacuum chamber of the die of FIG. 8.
Figure 9B:
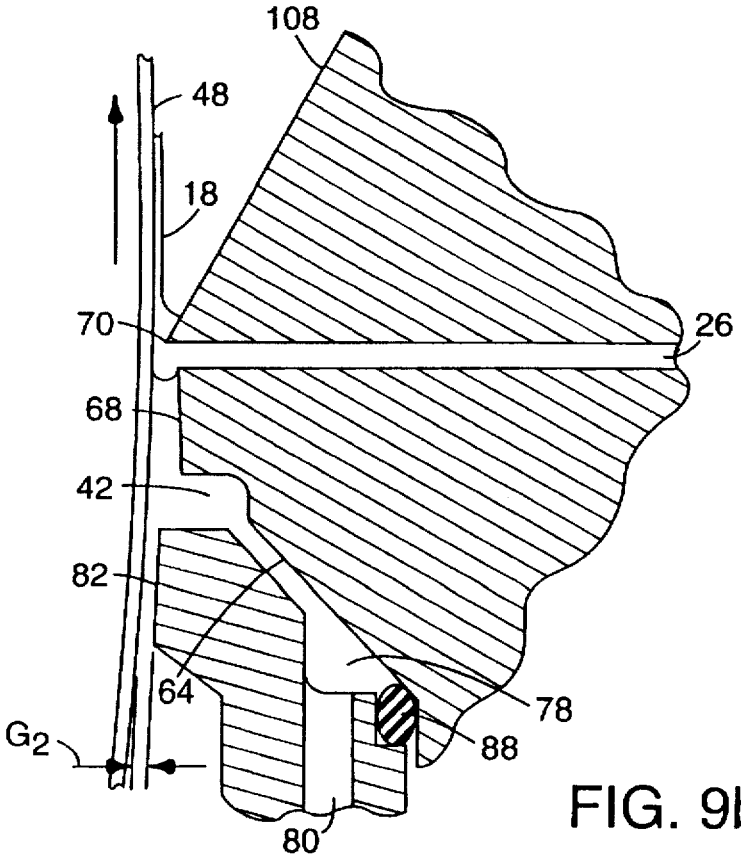

In FIGS. 8 and 9 the upstream bar 64 of the die 40 is mounted on an upstream bar positioner 84, and the vacuum bar 74 is mounted on a vacuum bar positioner 86. The curved land 68 on the upstream bar 64 and the vacuum land 82 on the vacuum bar 74 are not connected directly to each other. The vacuum chamber 42 is connected to its vacuum source through the vacuum bar 74 and the positioner 86. The mounting and positioning for the vacuum bar 74 are separate from those for the upstream bar 64. This improves performance of the die and allows precise, repeatable vacuum system gas flow. The robust configuration of the vacuum bar system also aids in the improved performance as compared with known systems. Also, this configuration for the vacuum bar 74 could improve performance of other known coaters, such as slot, extrusion, and slide coaters. A flexible vacuum seal strip 88 seals between the upstream bar 64 and the vacuum bar 74.

The gap $G_2$ between the vacuum land 82 and the web 48 is not affected by coating gap $G_1$, overbite O, or convergence C changes, and may be held at its optimum value continuously, during coating. The vacuum land gap $G_2$ may be set within the range from 0.076 mm to 0.508 mm. The preferred value for the gap $G_2$ is 0.15 mm. The preferred angular position for the vacuum land 82 is parallel to the web 48.

During coating, the vacuum level is adjusted to produce the best quality coated layer. A typical vacuum level, when coating a 2 centipoise coating liquid at 6 microns wet layer thickness and 30.5 m/min web speed, is 51 mm $H_2O$. Decreasing wet layer thickness, increasing viscosity, or increasing web speed could require higher vacuum levels exceeding 150 mm $H_2O$. Dies of this invention exhibit lower satisfactory minimum vacuum levels and higher satisfactory maximum vacuum levels than known systems, and in some situations can operate with zero vacuum where known systems cannot.

Figure 10A:
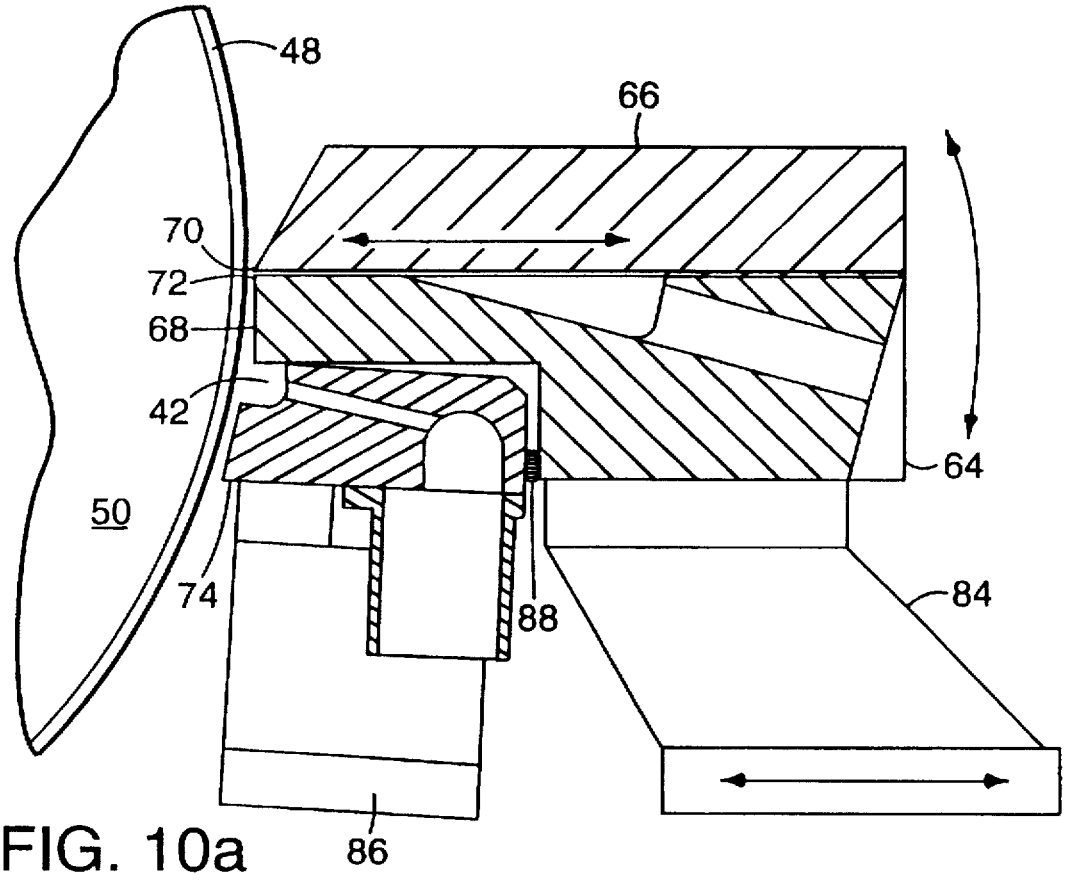
FIGS. 10*a* and 10*b* are schematic views of the die of FIG. 8.
Figure 10B:
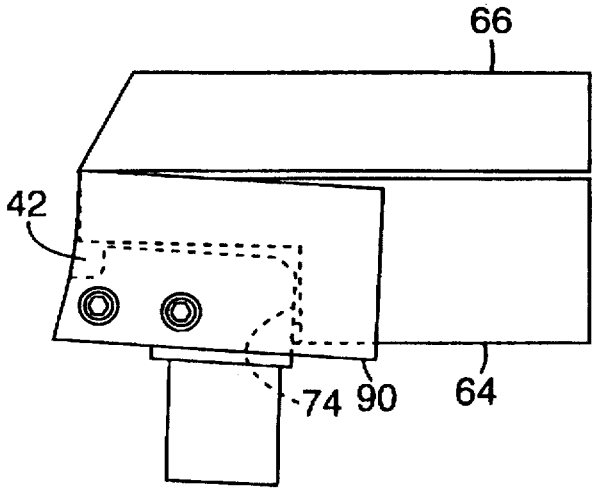

FIGS. 10*a* and 10*b* show some positioning adjustments and the vacuum chamber closure. Overbite adjustment translates the downstream bar 66 with respect to the upstream bar 64 such that the sharp edge 70 moves toward or away from the web 48 with respect to the downstream edge 72 of the curved land 68. Adjusting convergence rotates the upstream bar 64 and the downstream bar 66 together around an axis running through the downstream edge 72, such that the curved land 68 moves from the position shown in FIG. 10, away from parallel to the web 48, or back toward parallel. Coating gap adjustment translates the upstream bar 64 and the downstream bar 66 together to change the distance between the sharp edge 70 and the web 48, while the vacuum bar remains stationary on its mount 86, and the vacuum seal strip 88 flexes to prevent air leakage during adjustments. Air leakage at the ends of the die into the vacuum chamber 42 is minimized by end plates 90 attached to the ends of the vacuum bar 74 which overlap the ends of the upstream bar 64. The vacuum bar 74 is 0.10 mm to 0.15 mm longer than the upstream bar 64, so, in a centered condition, the clearance between each end plate 90 and the upstream bar 64 will range from 0.050 mm to 0.075 mm.

One unexpected operating characteristic has been observed during coating. The bead does not move significantly into the space between the curved land 68 and the moving web 48, even as vacuum is increased. This allows using higher vacuum levels than is possible with known extrusion coaters, and provides a correspondingly higher performance level. Even where little or no vacuum is required, the invention exhibits improved performance over known systems. That the bead does not move significantly into the space between the curved land 68 and the web 48 also means that the effect of "runout" in the backup roller 50 on downstream coating weight does not differ from that for known extrusion coaters.

Figure 11:
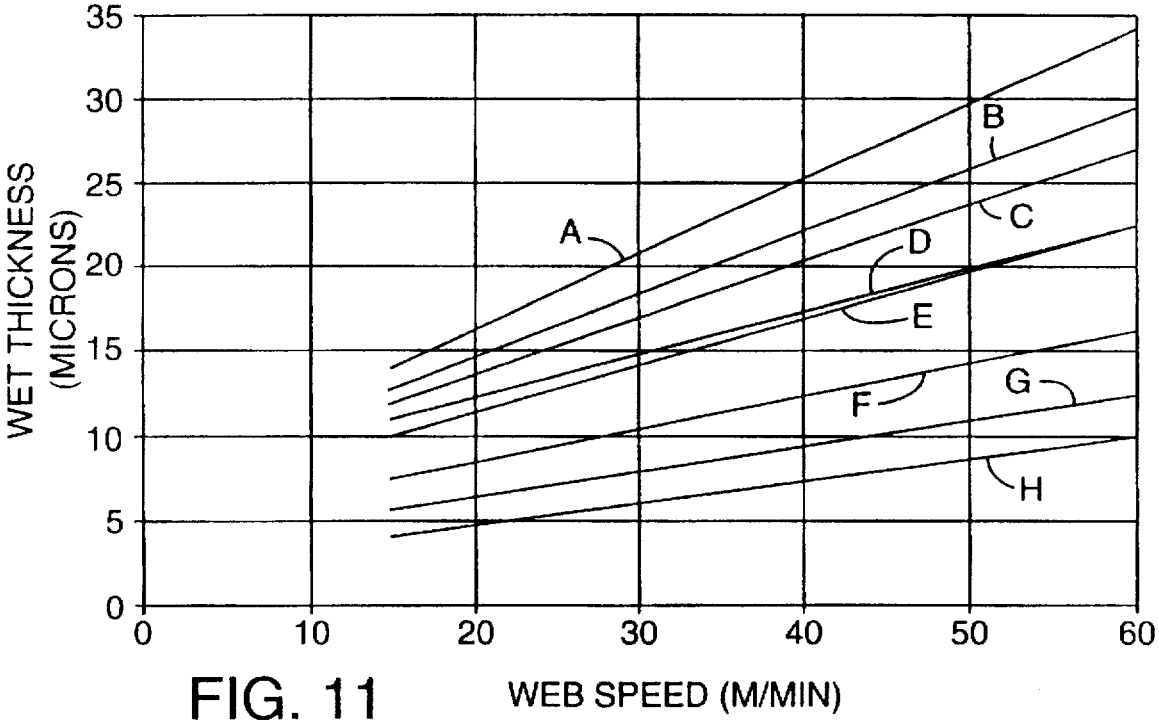
FIG. 11 shows coating test results which compare the performance of a known extrusion die and an extrusion die of the present invention for a coating liquid of 1.8 centipoise viscosity.
Figure 12:
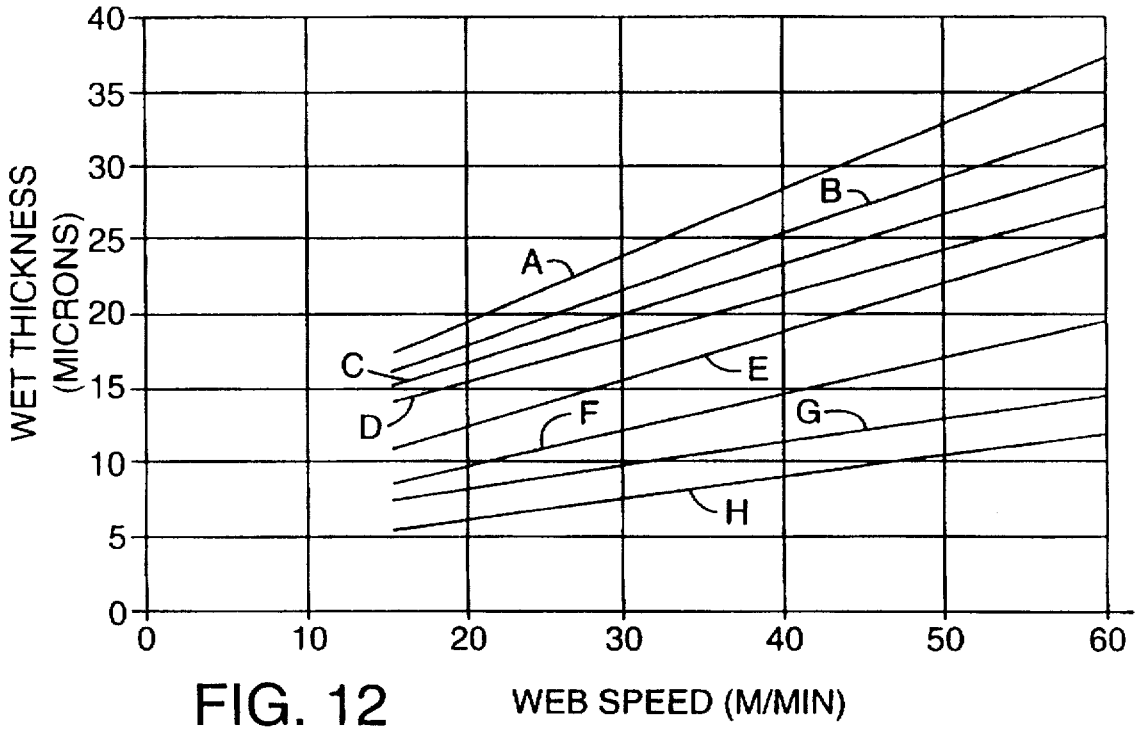
FIG. 12 shows comparative test results for a coating liquid of 2.7 centipoise viscosity.

FIG. 11 graphs results of coating tests which compare the performance of a known extrusion die with an extrusion die of this invention. In the tests, the 1.8 centipoise coating liquid containing an organic solvent was applied to a plain polyester film web. The performance criterion was minimum wet layer thickness at four different coating gap levels for each of the two coating systems, over the speed range of 15 to 60 m/min. Curves A, B, C, and D use the known, prior art die and were performed with coating gaps of 0.254 mm, 0.203 mm, 0.152 mm, and 0.127 mm, respectively. Curves E, F, G, and H use a die according to this invention at the same respective coating gaps. The lower wet thickness levels for this invention, compared to the prior art die, are easily visible. FIG. 12 shows comparative test results for a similar coating liquid of 2.7 centipoise viscosity, at the same coating gaps. Once again, the performance advantage for this invention is clearly visible.

FIG. 13 is a collection of data from coating tests where liquids at seven different viscosities, and containing different organic solvents, were applied to plain polyester film webs. The results compare performance of the prior art extrusion coater (PRIOR) and this invention (NEW). The performance criteria are mixed. Performance advantages for this invention can be found in web speed (Vw), wet layer thickness (Tw), coating gap, vacuum level, or a combination of these.

Figure 14:
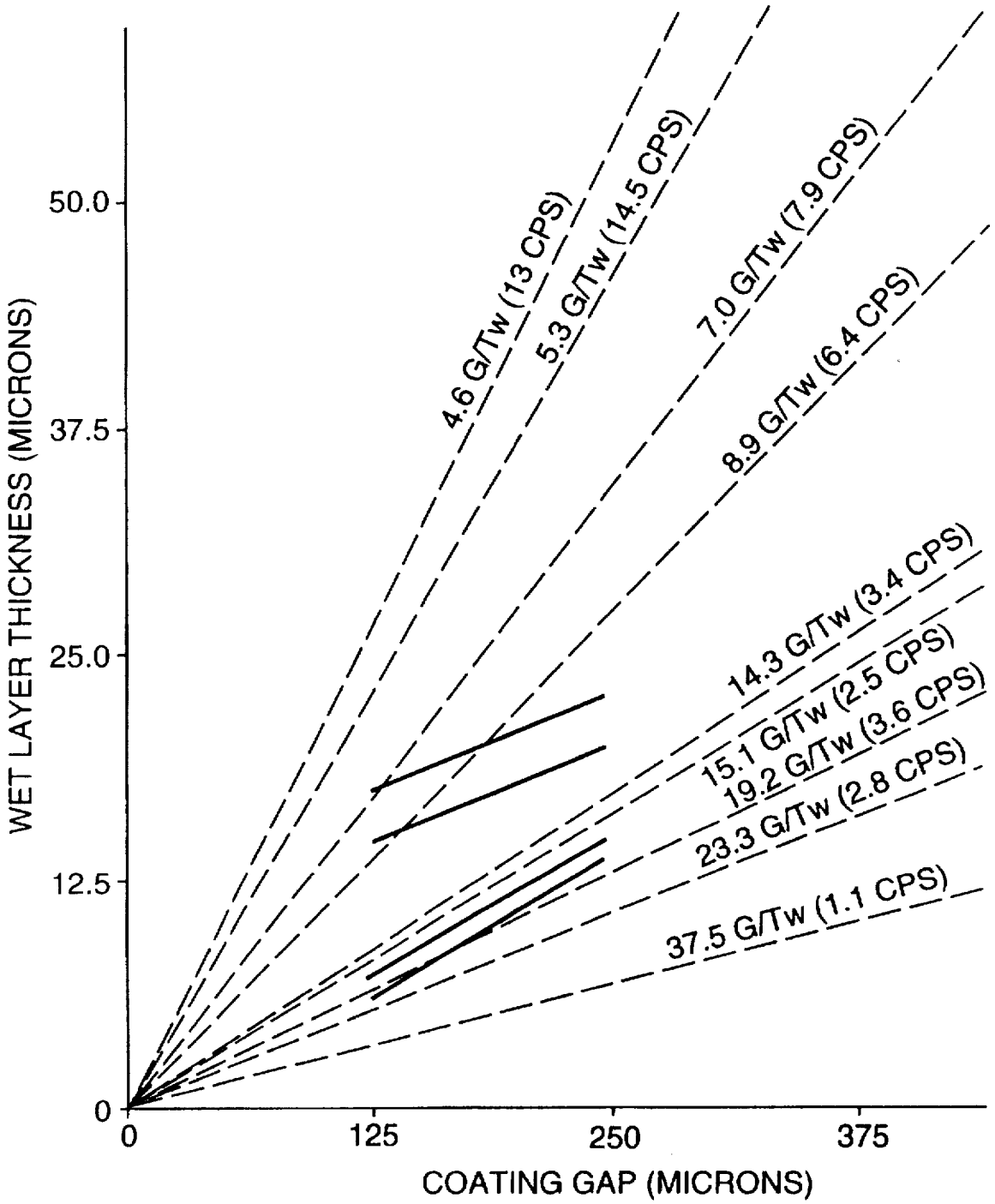
FIG. 14 is a graph of constant G/Tw lines for an extrusion coating die of the present invention for nine different coating liquids.

One measure of coater performance is the ratio of coating gap to wet layer thickness (G/Tw), for a particular coating liquid and web speed. FIG. 14 shows a series of constant G/Tw lines and viscosity values of an extrusion die of this invention, for nine different coating liquids. The liquids were coated on plain polyester film base at a web speed of 30.5 m/min. A few viscosity values appear to be out of order, due to the effect of other coatability factors. Four additional performance lines have been added after calculating the G/Tw values for 30.5 m/min web speed from FIGS. 11 and 12. From top to bottom, the solid performance lines are the G/Tw for liquids of 2.7 centipoise and 1.8 centipoise coated by a known extrusion die and the G/Tw for liquids of 2.7 centipoise and 1.8 centipoise coated by an extrusion die of this invention. The lines for of this invention represent greater G/Tw values than the lines for of the prior art coating die. In addition, the lines for this invention are close to being lines of constant G/Tw, averaging 18.8 and 16.8, respectively. The lines of the known coater show considerably more G/Tw variation over their length. This invention has a much improved operating characteristic for maintaining a coating bead at low wet thickness values, over known systems.

Figure 15:
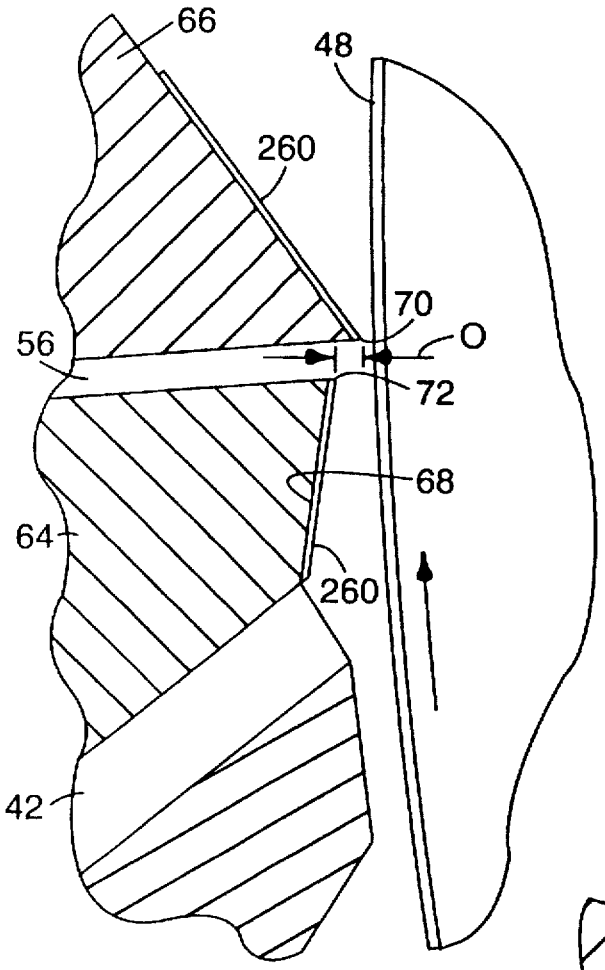
FIG. 15 is a cross-sectional view of the face of an extrusion die of the present invention having low surface energy coverings.

A common problem encountered with known extrusion die coaters is the occurrence of streaks in the coated layer, caused by dried liquid residue on the die lips near the coating bead. This is more prevalent with low viscosity liquids that contain a highly-volatile solvent. In FIG. 15, low surface energy coverings 260 are applied to the surface of the downstream bar 66 adjacent to the sharp edge 70, and to the curved land 68 adjacent to its downstream edge 72. This covering, can be a fluorinated polyethylene, and presents a generally undulating surface, even if applied to a precisely-ground metal base material. Best results are obtained if the overbite O is precisely set, side-to-side, on the die within 2.5 microns.

Figure 16:
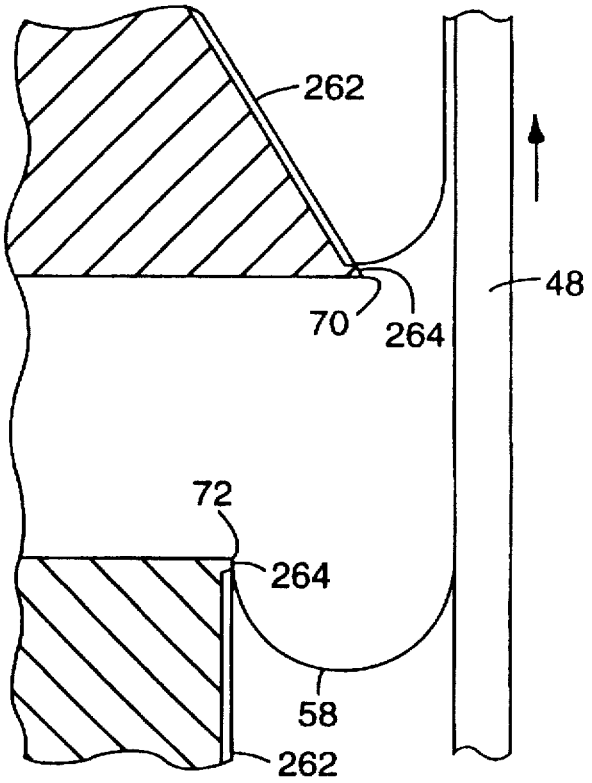
FIG. 16 is an enlarged cross-sectional view of a face of an extrusion die of the present invention, similar to that of FIG. 25.

In the embodiment of FIG. 16, the low surface energy coverings 260 do not extend to the edges 70 and 72. These coverings 260 can be applied as an inlay 262 formed by cutting a recess in the curved land 68, applying excess low surface energy material to overfill the recess, and then radiusgrinding the entire curved land such that the narrow metal strip 264 is flush with the "non-wetting" covering inlay 262. The depth of the inlay 262 can range from 0.076 mm to 0.102 mm. The width of the narrow strip 264 can range from 0.127 mm to 0.508 mm. A similar low surface energy inlay can be produced in the downstream bar 66 surface, starting 0.127 mm–0.508 mm above the sharp edge 70. With precisely-ground strips 264 adjacent the edges 70 and 72, precise adjustment of overbite is facilitated and the low surface energy layer is protected from damage and delamination.

We claim:

1. A die coating apparatus for coating fluid coating onto a surface comprising:

a die having an upstream bar with an upstream lip and a downstream bar with a downstream lip, wherein the upstream lip is formed as a land and the downstream lip is formed as a sharp edge having an edge radius no greater than 10 microns;

a passageway running through the die between the upstream and downstream bars, wherein the passageway comprises a slot defined by the upstream and downstream lips, wherein coating fluid exits the die from the slot to form a continuous coating bead between the upstream die lip, the downstream die lip, and the surface being coated; and a low surface energy covering applied to the surface of the downstream bar adjacent to the sharp edge, and a low surface energy covering applied to the land, adjacent to its downstream edge to present a generally undulating surface, wherein the low surface energy coverings do not extend completely to the edges of the downstream bar and the land.

* * * * *